United States Patent [19]

Martin

[11] 3,949,647

[45] Apr. 13, 1976

[54] HYDRAULIC MECHANISM, SUCH AS A MOTOR OR A PUMP, HAVING RADIAL PISTONS ADAPTED TO PERFORM A PLURALITY OF STROKES PER REVOLUTION

[75] Inventor: Louis E. Martin, Senlis, France

[73] Assignee: Societe Anonyme: Poclain, Le Plessis Belleville, France

[22] Filed: Oct. 2, 1974

[21] Appl. No.: 511,107

[30] Foreign Application Priority Data

Oct. 8, 1973 France ..... 73.35907

[52] U.S. Cl. ..... 91/485; 91/491

[51] Int. Cl.[2] ..... F01B 13/06

[58] Field of Search ..... 91/491, 484, 485, 498

[56] References Cited

UNITED STATES PATENTS

| | | | |
|---|---|---|---|
| 2,231,361 | 2/1941 | Ferris | 91/484 |
| 2,284,111 | 5/1942 | Vickers | 91/485 |
| 2,861,552 | 11/1958 | Creighton et al. | 91/485 |
| 2,970,578 | 2/1961 | Kohtaki | 91/484 |
| 3,181,477 | 5/1965 | Matthews | 91/485 |
| 3,274,898 | 9/1966 | Faisandier | 91/485 |
| 3,403,599 | 10/1968 | Guinot | 91/491 |
| 3,780,624 | 12/1973 | Webb | 91/498 |
| 3,796,136 | 5/1974 | Oguni | 91/491 |

FOREIGN PATENTS OR APPLICATIONS

| | | | |
|---|---|---|---|
| 1,816,662 | 7/1970 | Germany | 91/492 |

*Primary Examiner*—William L. Freeh

*Attorney, Agent, or Firm*—Lewis H. Eslinger; Alvin Sinderbrand

[57] ABSTRACT

In a pump or motor having a plurality of radial pistons adapted to perform a plurality of strokes per revolution, a stator, a rotor and a fluid-distributor slide valve fast with the stator and having a radially extending plane face opposite a radially extending plane face of said rotor, said slide valve is provided in a chamber which communicates with the interface between said faces and, by a pressure-maintaining device, with a substantially unpressurised enclosure such that the effect on said slide valve of the pressure of fluid in said chamber will substantially balance the effect of pressure of fluid acting on said interface between said faces.

7 Claims, 6 Drawing Figures

HYDRAULIC MECHANISM, SUCH AS A MOTOR OR A PUMP, HAVING RADIAL PISTONS ADAPTED TO PERFORM A PLURALITY OF STROKES PER REVOLUTION

The present invention is concerned with improvements in hydraulic mechanisms, such as motors and pumps, having pistons which perform a plurality of strokes per revolution of the rotor.

In such mechanisms it is necessary to allow fluid to be successively admitted to and delivered from the inlet chamber of the cylinder of a piston under consideration. In this type of mechanism the resultant of the pressure forces on the rotor is centered on the rotational axis of the rotor, but is not zero. The reaction force acting on the distributor tends to move it away from the face of the rotor opposite to it. This phenomenon is particularly troublesome when the distributor consists of a plane distributor slide valve, which must then be kept in position opposite the corresponding face of the rotor.

It should be noted that the force which maintains this distributor slide valve in position must be sufficiently large to prevent excessive play between the slide valve and the rotor, but must nevertheless be sufficiently small to avoid the risk of premature wear and even seizure of the opposing faces.

The invention proposes a new arrangement by which the maintaining force can be correctly adjusted with due regard to the operational clearance between the faces, and to the pressures of the fluids admitted to and delivered from the mechanism.

According to the invention there is provided an hydraulic mechanism such as a motor or a pump having radial pistons adapted to perform a plurality of strokes per revolution comprising a stator, a rotor rotatable relative to said stator, a fluid-distributor slide valve rotationally fast with said stator and which has a plane face opposite a plane face of said rotor, there being an interface between said two faces, and an annular balancing chamber bounded by said stator and said rotor and in communication with the periphery of said interface, by means of a pressure-maintaining device, with a substantially pressure-free enclosure, said distributor slide valve being within said balancing chamber, the arrangement being such that the effect of the pressure of fluid in said balancing chamber on said distributor slide valve will oppose the effect of pressure of fluid acting on said slide valve in the region of said interface and is capable of substantially balancing this effect.

The pressure maintaining device may comprise a calibrated orifice forming a restriction. Alternatively, where the distributor slide valve as high and low pressure apertures, the pressure maintaining device may comprise a poppet valve of which the movable element is subject to the action of three jacks whose supply chambers are in communication with the high pressure aperture, the low pressure aperture and the balancing chamber respectively, the effects of the fluids in the chambers of the jacks communicating with the high and low pressure apertures opposing that of the fluid in the chamber of the jack communicating with the balancing chamber, and tending to maintain the poppet valve in its closed position. The cross-sections of these jacks are preferably proportional to those of the apertures and of the distributor slide valve bounding the balancing chamber.

A resilient member may be interposed between the distributor slide valve and the rotor, so as to tend to reduce the width of the interface between the plane faces.

The invention will be better understood from the following description of embodiments thereof, given by way of example only, with reference to the accompanying drawings, wherein.

Figure 1:
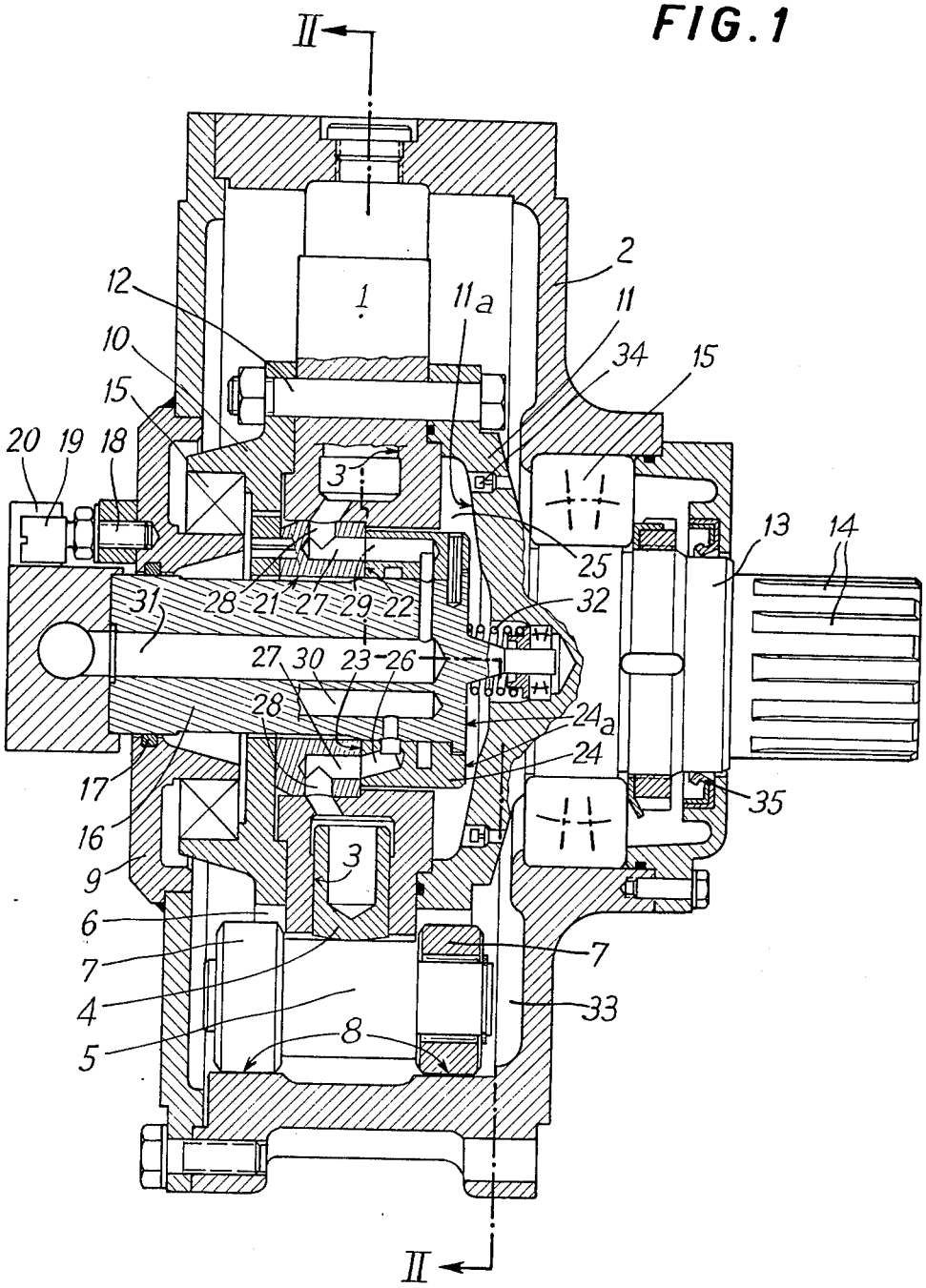
FIG. 1 is an axial section along the line I—I of FIG. 2 through an embodiment of a hydraulic motor according to the invention.
Figure 2:
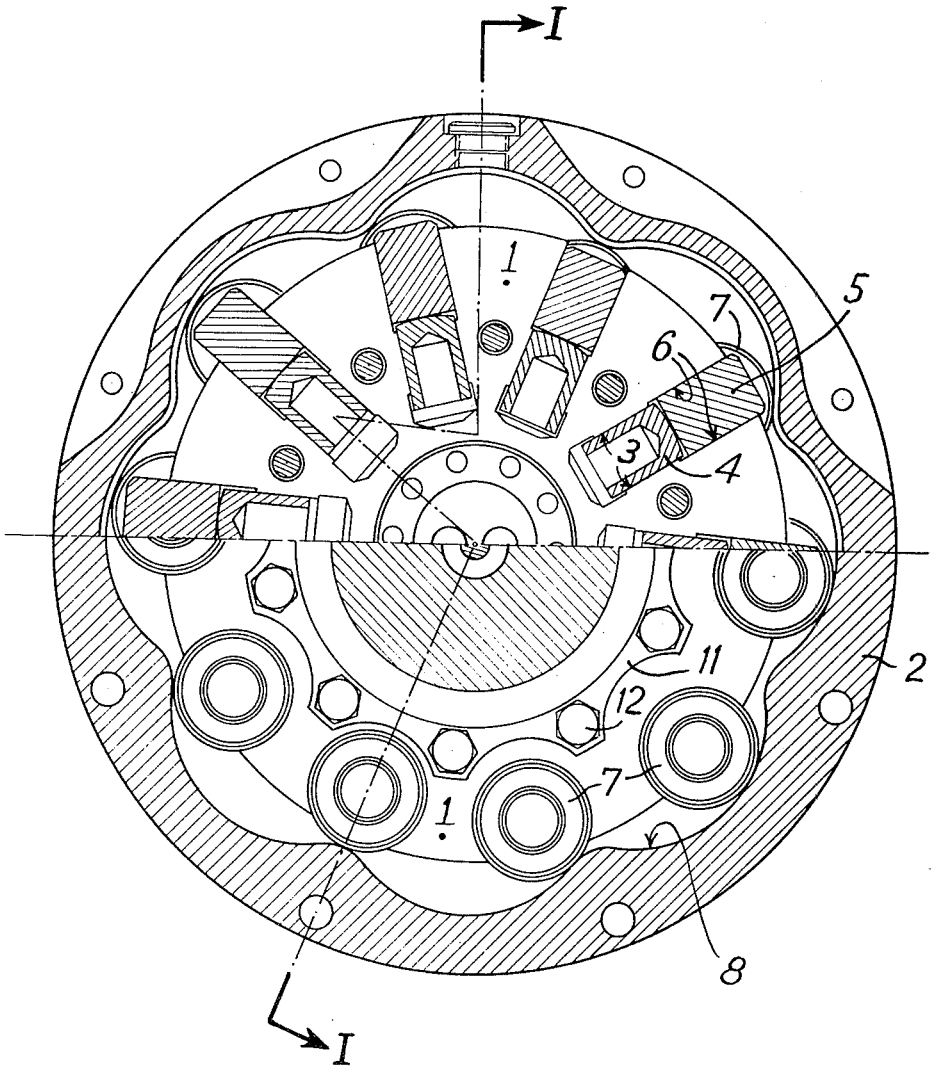
FIG. 2 is a transverse section of the motor of FIG. 1, along the line II—II of the FIG. 1.

The motor illustrated in FIGS. 1 and 2 consists of a cylinder block 1 disposed in a housing 2. The cylinders 3 in the cylinder block are radially disposed, and a piston 4 is slidably mounted in each cylinder. Each piston 4 bears against a member 5, which is itself mounted so as to slide radially between two guide walls 6 in the cylinder block 1, two rollers 7 rotatably mounted on each member 5 bearing against an undulating cam 8 fast with the housing 2.

The housing 2 includes a detachable closure plate 9, enabling the cylinder block 1 to be introduced into the housing.

Two end members 10 and 11 are fixed by bolts 12 to the end faces of the cylinder block 1. A shaft 13, provided with external driving splines 14, forms the output shaft of the motor, and is fast with the end member 11. This motor is thus of the conventional type in which the cylinder block forms the rotor and the housing forms the stator. Bearings 15 are interposed between the end member 10 and the closure plate 9 of the housing 2, and between the shaft 13 and the housing 2, to mount the cylinder block 1 so that it can rotate relative to the housing 2.

Inside the housing 2 there is a cylinder 16 which passes through the closure plate 9 of the housing and is sealed relative thereto by a fluid-tight packing 17. The cylinder 16 is made rotationally fast with the housing 2 by an adjusting screw 18 screwed into the plate 9 and provided with an eccentric 19 which co-operates with a groove 20 in the cylinder 16 to enable the relative angular position of the cylinder 16 with respect to the housing 2 to be adjusted. The cylinder 16 passes freely through a bore 21 in the cylinder block 1, and extends beyond a plane face 22 with which the cylinder block 1 is equipped, and which is disposed opposite the internal face 11*a* of the end member 11. The plane face 23 of a distributor slide valve 24 is disposed opposite face 22. The cylinder block 1 defines, together with the internal face 11*a* of the member 11, a chamber 25 of the so-called balancing type inside which the distributor slide valve 24 is disposed.

It will be noted that inlet aperture 26 for fluid under pressure, in the form of a plurality of orifices regularly disposed in the face 23 of the distributor slide valve 24, is in communication with orifice 27 of a conduit 28 in the cylinder block 1 and communicating with a cylinder 3, while similarly a fluid-delivery aperture 29, likewise in the form of a plurality of orifices regularly disposed in the face 23 of the slide valve 24, is itself in communication with the orifice 27 of another conduit 28 communicating with another cylinder 3. The apertures 26 and 29 communicate with inlet conduits 30 and fluid-delivery conduit 31 in the cylinder 16. It should be noted that the cross-sections of the inlet aperture 26, the delivery aperture 29 and the end face 24*a* of the distributor slide valve 24 opposite to the face 11*a* of the end member 11 have the values $S_{26}$, $S_{29}$ and $S_{24a}$ respectively.

A spring 32 is interposed between the distributor slide valve 24 and the housing 2, and is effective to urge the face 23 of the slide valve 24 towards the face 22 of the cylinder block 1. Furthermore, the balancing chamber 25 is in communication with the interior 33 of the housing 2 by way of of a calibrated orifice 34 in the end member 11 and which forms a restriction. The interior 33 of the housing in fact constitutes an enclosure at substantially zero pressure. Finally, a fluid-tight packing 35 is interposed between the shaft 13 and the housing 2.

Figure 3:
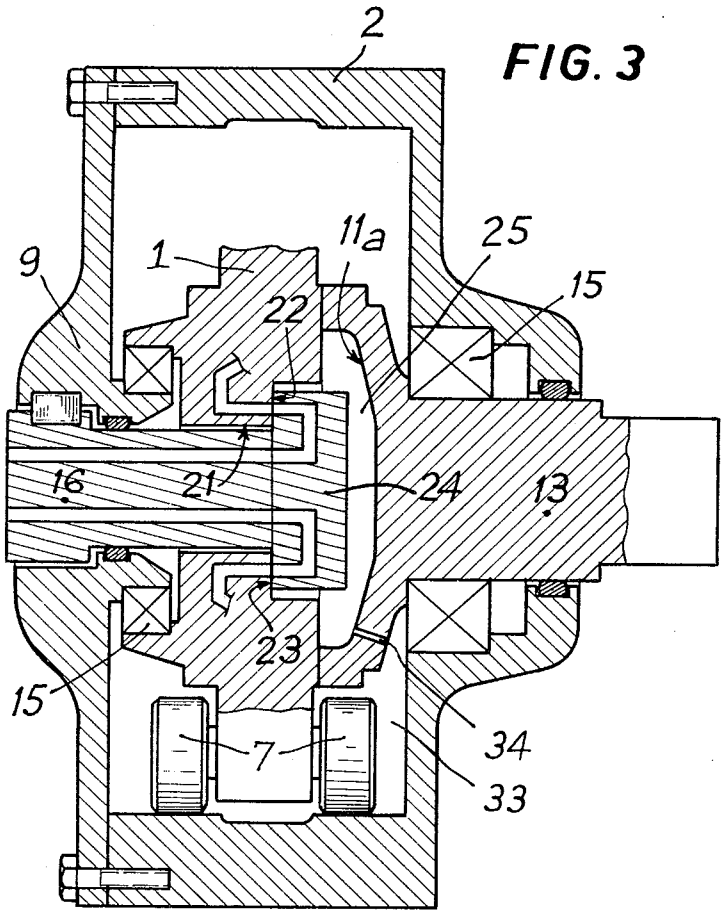
FIG. 3 is a diagrammatic axial section through the motor of FIG. 1 and similar to FIG. 1.

FIG. 3 is a simplified diagrammatic illustration of the motor of FIGS. 1 and 2.

Figure 4:
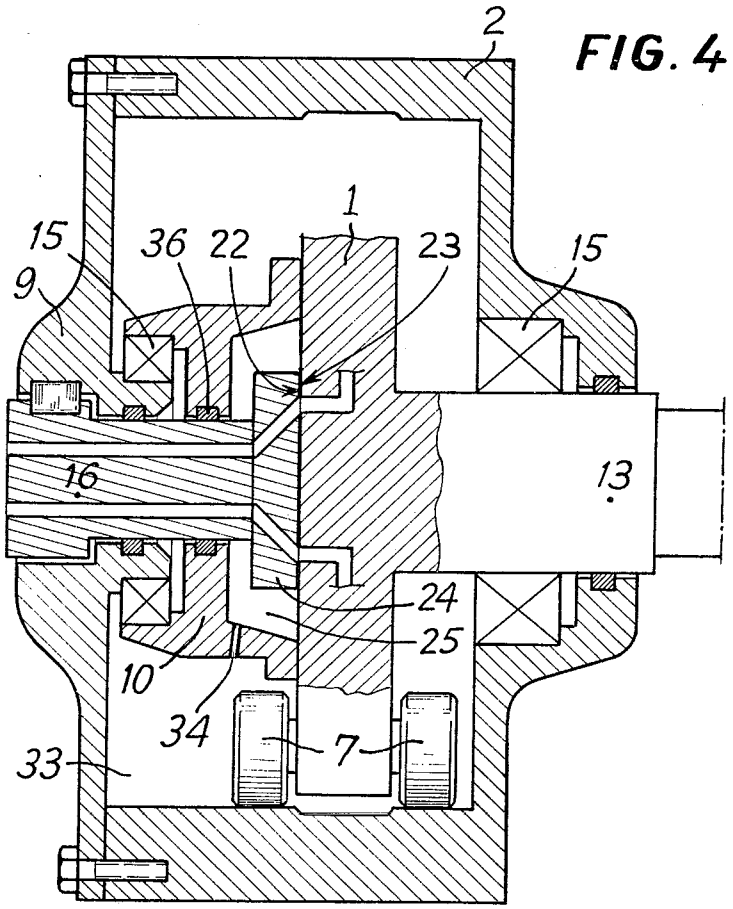
FIGS. 4 and 5 are axial sections similar to those of FIG. 3 through two other embodiments.

FIG. 4 illustrates a modification of the embodiment of FIG. 3 in which the distributor slide valve 24 is disposed on the same side of the cylinder block 1 as closure plate 9, rather than on the opposite side. This arrangement dispenses with the need for the bore 21 in the cylinder block. In this embodiment the balancing chamber 25 is accommodated between the cylinder block 1 and the end member 10, which is fixed there. In order that this chamber 25 may retain its character of an isolated enclosure, a complementary fluid-tight packing 36 is disposed between the cylinder 16 and the end member 10. A calibrated orifice 34 again connects the balancing chamber 25 to the interior 33 of the housing 2. In this embodiment, this orifice 34 passes through the wall of the end member 10.

Figure 5:
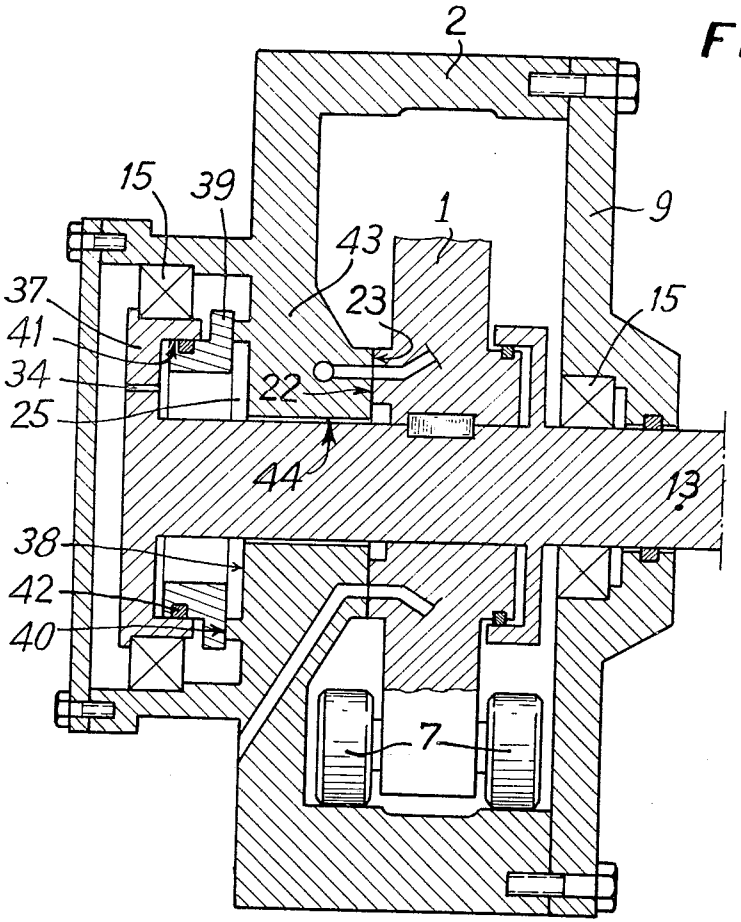

A further modification is illustrated in FIG. 5, and which in general construction is similar to the embodiment of FIG. 3. This embodiment differs therefrom in that its balancing chamber 25 is in part bounded by the housing 2. This chamber 25 is then bounded by an end member 37 fast with the shaft 13, by one of the transverse end faces 38 of a wall 43 of the housing 2, and by an intermediate ring 39 which bears against a rim 40 fast with the face 38, and which is opposed to a cylindrical face 41 fast with the member 37, a fluid-tight packing 42 being interposed between the ring 39 and the cylindrical face 41. The shaft 13 passes freely through a bore 44 in the wall 43 of the housing 2, so that the balancing chamber 25 is in free communication with the interface of the plane faces 22 and 23. Finally, the chamber 25 communicates with the interior 33 of the housing 2 by way of a calibrated orifice 34 in the end member 37. The cylinder block 1 is itself keyed to the shaft 13.

Figure 6:
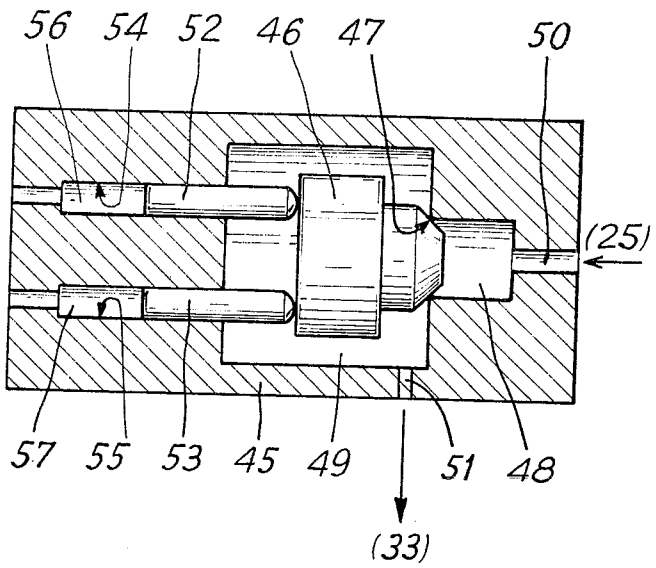
FIG. 6 is a section through a device for use in the invention.

Finally, FIG. 6 illustrates a device for use in place of the calibrated orifice 34 in any of the above described embodiments. The device consists of a poppet valve comprising a body 45 and a movable element 46 capable of bearing against a seat 47 on the body 45. The element 46 bounds, together with the body 45, an inlet chamber 48 and a delivery chamber 49, in communication with the balancing chamber 25 and with the interior 33 of the housing 2 respectively by way of two orifices 50 and 51. The chambers 48 and 49 are in communication when the poppet valve is open. Two pistons 52 and 53 are slidable in bores 54 and 55 in the body 45, and, together with the body 45, bound chambers 56 and 57 which are in communication with the apertures 26 and 29 respectively. The action of the pressure of fluid on the pistons 52 and 53 tends to maintain the pistons against the element 46, and to maintain this element 46 against the seat 47 on the body 45, in a position in which the valve is closed. The action of the pressure of the fluid in the chamber 48 on the element 46 is opposite to the foregoing, and tends to open the valve. These pressures act on cross-sections respectively equal to $S_{52}$, $S_{53}$ and $S_{46}$. It will be appreciated that the lefthand end portion of the element 46 and the chamber 48 can be considered as a piston and cylinder, the effective area of the piston being $S_{46}$.

The operation of the above-described motors will now be explained.

Reference will first be made to FIGS. 1, 2 and 3. When the conduit 30 is supplied with fluid under pressure, this fluid acts on some of the pistons 4, and sets the shaft 13 of the motor in rotation. However, the forces exerted by the fluid on the cross-sections $S_{26}$ of the apertures 26 and those exerted on the cross-sections $S_{29}$ of apertures 29 tend to separate the faces 22 and 23, the eccentric 19 and the slide valve 24 being allowed to slide relative to the cylinder block 1 because of the provision of the groove 20. Without any position maintaining means, the distributor slide valve 24 would move away from the cylinder block 1 in an irregular manner and fluid under pressure from the apertures 26 would flow into the housing 2 without producing any driving work whatever. In the embodiment illustrated, such fluid flows, not directly into the housing 2, but first into the chamber 25. The chamber 25 being closed, and communicating with the housing 2 only by way of the calibrated orifice 34, a given pressure, not zero, and depending on the size of the orifice 34, is maintained therein. This pressure acts on the cross-section $S_{24a}$ of the distributor slide valve 24 to balance the effect of the forces on the cross-sections $S_{26}$ and $S_{29}$ of the apertures 26 and 29, and to keep the faces 22 and 23 at a substantially constant clearance.

Should the face 23 of the distributor slide valve 24 move too far away from the face 22 of the cylinder block 1, the pressure would rise in the balancing chamber 25 and restore the clearance between the faces 22 and 23 to the correct value, by increasing the force on the cross-section $S_{24a}$. Should the faces 22 and 23 come too close to one another, an increase in the force on the cross-sections $S_{26}$ and $S_{29}$ would cause the faces 22 and 23 to move away from one another again and restore the clearance between these faces to the correct value. It will therefore be seen that the clearance between the faces 22 and 23 can be maintained at a substantially constant and optimum value as a result of judicious selection of the size of the orifice 34.

If a finer adjustment is desired, better than that obtained by use of the calibrated orifice 34, it is sufficient to adopt the device of FIG. 6. The poppet valve isolates the chamber 25 from the interior 33 of the housing 2, and the desired pressure is maintained therein, as long as optimum operating conditions obtain. The cross-sections $S_{52}$, $S_{53}$ and $S_{46}$ are chosen in order to effect this. As soon as any unbalance occurs and one of the pressures in the chambers 56, 57 drops and/or the pressure in the chamber 48 rises, the poppet valve opens to restore the pressure in the chamber 48, and consequently in the chamber 25, to the optimum value. The cross-sections $S_{52}$, $S_{53}$ and $S_{46}$ are advantageously chosen to be proportional to the cross-sections $S_{26}$, $S_{29}$ and $S_{24a}$, so that the slave reaction will be proportional to the action of the variable pressures which produce the unbalance which is to be corrected.

The embodiment of FIG. 4 operates in a manner similar to the operation of the embodiment of FIGS. 1 to 3, and therefore does not require any particular comments.

The embodiment of FIG. 5 is interesting, since it leads to the construction of a balancing chamber whose dimensions do not depend directly on the size of the distributor slide valve 24 as in the embodiments of FIGS. 3 and 4.

The action of the spring 32 in the embodiment of FIG. 1 naturally co-operates in maintaining the distributor slide valve 24 in correct position relative to the cylinder block 1.

It will be appreciated that the invention is equally applicable to hydraulic pumps which may have constructions which are the same as to those of the above described motors.

It should be noted that the embodiments illustrated enable the forces tending to separate the slide valve face 23 from the plane face 22 of the rotor to be exactly balanced, if necessary. This peculiarity is due to its particular use in motors or pumps having radial pistons and which perform a plurality of strokes per revolution. In fact, as already stated, the separating force in such motors is centred on the rotational axis of the motor and may be balanced by another force, as opposed to the arrangements relating to the plane slide valves in motors having axial pistons and a single stroke per revolution, wherein the separating force, parallel to the rotational axis, is offset with respect to this axis, and which also sets up a rocking torque. Such a torque clearly cannot be opposed by the pressure prevailing in a chamber similar to the chamber 25, the more so since the value of the balancing pressure in such mechanisms having axial pistons must necessarily be limited in order not to risk imparting even greater unbalance to the slide valve. It will therefore be understood that the arrangements described in the application contribute a specific result in conjunction with mechanisms having radial pistons.

It should finally be noted that the arrangements hereinbefore described are most especially suitable for motors having radial pistons and variable cylinder capacity, wherein the axial resultant of the separating force is variable with the chosen cylinder capacity.

For the remainder, the invention is not limited to the embodiments which have been described, but on the contrary covers all variants which could be made within the spirit and scope of the invention.

What is claimed is:

1. A hydraulic mechanism, such as a motor or pump, having radial pistons adapted to perform a plurality of strokes per revolution, comprising:

an enclosed housing;

a stator mounted in said housing;

a rotor rotatably mounted in said housing for rotary movement with respect to said stator;

said rotor having a plane face thereon through which fluid is supplied and exhausted to reciprocate said pistons;

a stationary fluid-distributor slide valve on said stator having a plane face opposite the plane face on said rotor, and defining an interface therebetween said stator and said rotor defining therebetween an enclosed balancing chamber in communication with the periphery of said interface between the rotor and slide valve;

said housing defining a substantially pressure-free enclosure surrounding said rotor, said distributor slide valve being located within said balancing chamber; and means for providing communication between said balancing chamber and said pressure-free enclosure and for maintaining pressure in said enclosure;

whereby the effect of pressure of fluid in said balancing chamber on said distributor slide valve will oppose the effect of pressure of fluid acting on said slide valve in the regon of said interface to substantially balance this effect.

2. A mechanism according to claim 1, wherein said pressure-maintaining means comprises a calibrated orifice forming a restriction.

3. A mechanism according to claim 1, including a resilient member interposed between said distributor slide valve and said rotor and effective to tend to reduce the width of said interface between said plane faces.

4. A mechanism according to claim 1, wherein said distributor slide valve has high and low pressure apertures formed therein and said pressure maintaining means comprises a poppet valve having a first orifice in communication with said balancing chamber, a second orifice in communication with said pressure-free chamber, and third and fourth orifices respectively in communication with said high and low pressure apertures, and a movable valve element located in the valve to normally prevent fluid flow between said first and second orifices and positioned to be subject to the opposing effects of fluid in the first orifice and fluid in the second and third orifices.

5. A mechanism according to claim 1, wherein said distributor slide valve has high and low pressure apertures formed therein and said pressure-maintaining means comprises a poppet valve including a movable element subject to the pressures of fluid in (1) said high pressure aperture, (2) said low pressure aperture and (3) said balancing chamber, the effects of the pressure of fluids in said high and low pressure apertures opposing that of the pressure of fluid in said balancing chamber, and tending to keep said poppet valve in its closed position.

6. A mechanism according to claim 5, wherein said movable element is engaged by three pistons movable in cylinders in communication with said high pressure aperture, said low pressure aperture and said balancing chamber.

7. A mechanism according to claim 6, wherein the cross-sections of said pistons are respectively substantially proportional to the cross-sections of said high and low pressure apertures and to the cross-section of said distributor slide valve bounding said balancing chamber.

* * * * *